US007160045B2

(12) United States Patent
Oas

(10) Patent No.: US 7,160,045 B2
(45) Date of Patent: Jan. 9, 2007

(54) ILLUMINATED HIGHLIGHTER AND ADVERTISING VEHICLE

(75) Inventor: Daniel Oas, Irwindale, CA (US)

(73) Assignee: Calibre International, LLC, Irwindale, CA (US)

( * ) Notice: Subject to any disclaimer, the term of this patent is extended or adjusted under 35 U.S.C. 154(b) by 186 days.

(21) Appl. No.: 10/798,765

(22) Filed: Mar. 10, 2004

(65) Prior Publication Data

US 2005/0201814 A1 Sep. 15, 2005

(51) Int. Cl.
*B43K 29/00* (2006.01)
*B43K 5/12* (2006.01)
*B43K 29/10* (2006.01)

(52) U.S. Cl. ..... 401/195; 401/192; 362/118

(58) Field of Classification Search ..... 401/52, 401/195, 192, 198, 199; 362/118
See application file for complete search history.

(56) References Cited

U.S. PATENT DOCUMENTS 3,045,111 A * 7/1962 Hoenig ..... 362/579
4,518,274 A 5/1985 Hanggi
5,143,465 A 9/1992 Hou
5,405,208 A 4/1995 Hsieh
5,470,164 A 11/1995 Chen
5,803,583 A 9/1998 Hsieh
6,099,185 A 8/2000 Huang
6,129,473 A 10/2000 Shu
6,164,856 A 12/2000 Lo
6,238,057 B1 5/2001 Chen
6,299,372 B1 10/2001 Wang
6,390,641 B1 5/2002 Liu
6,439,735 B1 8/2002 Shu

* cited by examiner

*Primary Examiner*—David J. Walczak
(74) *Attorney, Agent, or Firm*—Thomas I. Rozsa

(57) ABSTRACT

A writing instrument with an illuminated ink reservoir. The writing instrument includes a light source, a power supply, a power switch, and an ink reservoir defined by a portion of the instrument body that is generally capable of transmitting light. The ink reservoir contains ink, preferably flourescent marking ink that will glow brightly when illuminated by the light source. The writing instrument further comprises a light conducting member that guides the majority of light emitted from the light source into generally the center axis of the ink reservoir. The light conducting member helps to guide and focus the light into the ink within the reservoir. The light source may be an ultraviolet "black light", that causes the ink to glow brightly and produces a spellbinding visual effect. Advertising material may be imprinted on the instrument for advertising.

29 Claims, 2 Drawing Sheets

ILLUMINATED HIGHLIGHTER AND ADVERTISING VEHICLE

BACKGROUND OF THE INVENTION

The present invention relates to writing instruments capable of self illumination. More specifically, the present invention relates to a pen, marker, or highlighter with an electrically powered source of illumination contained within the device. The present invention even more specifically relates to a highlighter marker that has a powered light source, the light being guided towards the central axis of an ink reservoir containing a collection of ink, and preferably a flourescent ink. The ink will luminesce, glow, and emit light when the light source is switched on. The present invention also relates to a method of advertising by providing a consumer or a business with a writing instrument capable of illuminating an ink reservoir.

There are several varieties of writing instruments. Highlighting markers are also well known in the prior art. Typically, these specialized markers are utilized, for example, by students to mark important text in a book, or by office personnel and professionals to mark important parts of documents. Over the years, several ink colors have become available besides the customary yellow markers. More recently, fluorescent highlighting ink has been available as a choice to the consumer. Furthermore, some manufacturers of highlighter markers have utilized a clear ink reservoir as part of a writing instrument body in order to display the ink remaining within the reservoir and to make the writing instrument more interesting in appearance. These markers with a clear ink reservoir have become very popular.

Combining a writing instrument with a light source is also well known in the art. The motivation to do so is usually to provide light for the user of the instrument to see a writing surface in a darkened room. However, lights have also been combined with pens to provide either an interesting visual effect or to bring advertising to the attention of a consumer. In the prior art, only the exterior of the writing instrument has been illuminated. The prior art, in fact, teaches away from directing light into an ink reservoir.

U.S. Pat. No. 6,164,856 to Lo discloses a lighted pen in which logos on a transparent body and the pen tip are illuminated by means of a light source and a convex circular cylindrical optical lens. The writing implement has a built-in illumination system that includes a pen-top, a translucent pen-body, and a translucent pen-tip. A battery, an electrical switch and a lamp are housed within the pen-top. A convex circularly cylindrical optical lens is positioned between said lamp and said marking element so that light from the lamp is diverted away from the central axis of the pen, towards the peripherally translucent pen-body. The light then propagates along the periphery of the pen to the pen-tip. As a result of the lens, printed information located on the pen-body is illuminated, as well as a region located immediately adjacent to the pen-tip. In this patent, the pen ink itself is not illuminated and this patent teaches away from directing light down the center axis into an ink reservoir.

U.S. Pat. No. 5,405,208 to Hsieh discloses a pen with illuminating function. A switch assembly is disposed in an upper end of the upper pen sleeve, whereby a circuit is opened or closed to turn on or off a bulb or LED located at the pen tip. The pen provides an illuminating effect for the user to write in a dim place while enabling the user to write without obstruction. In this patent, the pen ink is not illuminated and the LED is in the very tip of the writing end of the pen.

U.S. Pat. No. 6,238,057 to Chen discloses a combination light pen, wherein the lower barrel comprises a water chamber disposed around an ink cartridge, with display items floating inside the water chamber. Light from an LED passes through the items in the water chamber and illuminates them. Here, the illuminated chamber contains water and does not contain ink. The ink cartridge is isolated from the illumination. Also, there is no light conductive member directing the path of the light towards the central axis of the pen. Finally, the liquid in the illuminated chamber is not fluorescent.

U.S. Pat. No. 6,299,372 to Wang discloses an advertising effect photo pen. The front tube of the pen is a hollow transparent material and a refill is connected at a front end. The surface of the front tube is formed with a transparent surface and a shielding surface and the shielding surface or the transparent surface has advertise patterns. When the user touches a light emitting unit, the transparent surface and the surface of the front tube will light up to present an advertise effect. The light is not directed through the ink and the ink does not glow or light up.

Other patents disclosing illuminating pens with a switched light source are U.S. Pat. Nos. 6,439,735; 6,390,641; 6,129,473; 6,099,185; 5,803,583; 5,470,164; 5,143,465; 4,518,274. None of these patents teach the desirability of guiding the light emitted from a light source directly into the ink chamber. Directing light down the central axis of an ink reservoir is not disclosed in the prior art. Moreover, the prior art teaches away from directing light down the central axis of a writing instrument. Furthermore, none of these patents teach using a light source to illuminate ink, and more specifically a flourescent ink, in combination with a writing instrument.

SUMMARY OF THE INVENTION

It is an object of the present invention is to provide a light source within a writing instrument thereby providing an unusual and interesting visual effect. Additionally, it is an object of the present invention to provide a highlighting type of marker with a light source that will illuminate the ink in an ink reservoir. The visual effect will capture the interest of the consumer and will result in increased sales of the marker.

Another objective of the present invention is to guide the light from a light source down the central axis of an ink reservoir into a transparent or translucent ink reservoir, wherein by directing the light generally down the central axis of the ink reservoir, the ink in the reservoir with glow. Furthermore, by providing an ultraviolet ("black light") light source, a flourescent ink in the ink reservoir will glow or luminesce extra brightly.

Another object of the present invention is to provide a method of advertising utilizing a writing instrument with an illuminated ink chamber. The method includes attracting the attention of a consumer to advertising upon a writing instrument. The method further includes providing the writing instrument to a business. Advertising is placed on the pen body. An unusual and interesting visual effect comprising glowing illuminated ink within a writing instrument, will attract the attention of a consumer or business to the advertising associated with the writing instrument.

In the preferred embodiment of the present invention, the objectives are provided by an illuminated writing instrument comprised of a light source. Said light source, is connected with a power supply, and the light source is controlled by a switch. An ink reservoir capable of transmitting light is incorporated into the writing instrument body. The ink reservoir contains ink, preferably marking ink. The marking ink, furthermore, may be flourescent which will cause the ink to glow brightly when illuminated by the light source. The writing instrument in the preferred embodiment further comprises a light conducting member that guides the illumination from the light source generally into the center axis of the ink reservoir. The light conducting member helps to guide and focus the light into the ink within the reservoir. The light causes the ink within the reservoir to luminesce. A pen tip is in communication with the ink reservoir. Various pen tips well known in the prior art are suitable. In the preferred embodiment, the writing instrument is a highlighting marker and the marking ink is flourescent. The light source may be an ultraviolet "black light", that causes the ink to glow even more brightly and produces a spellbinding visual effect.

Still other objects and advantages of the present invention will become readily apparent to those skilled in the art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

The foregoing objects, features, advantages and preferred embodiments of the evacuation unit and method of the present invention will be better understood from the following detailed description taken in conjunction with the accompanying drawings in which.

DETAILED DESCRIPTION OF THE PREFERRED EMBODIMENTS

The accompanying Figures depict embodiments of the present invention, and features and components thereof. With regard to means for fastening, mounting, attaching or connecting the components of the present invention to form the apparatus as a whole, unless specifically described otherwise, such means are intended to at least encompass conventional fasteners such as machine screws, machine threads, snap rings, hose clamps such as screw clamps and the like, rivets, nuts and bolts, toggles, pins and the like. Components may also be connected by friction fitting, snap fitting, adhesives, threads, or by welding or deformation, if appropriate. Unless specifically otherwise disclosed or taught, materials for making components of the present invention are selected from appropriate materials such as metal, metallic alloys, natural or synthetic fibers, plastics and the like, and appropriate manufacturing or production methods including casting, extruding, molding and machining may be used.

Any references to front and back, right and left, top and bottom, upper and lower, superior and inferior, and horizontal and vertical are intended for convenience of description, not to limit the present invention or its components to any one positional or spacial orientation. Any references to "pen" is intended to encompass a variety of writing instruments well known in the art.

Figure 1:
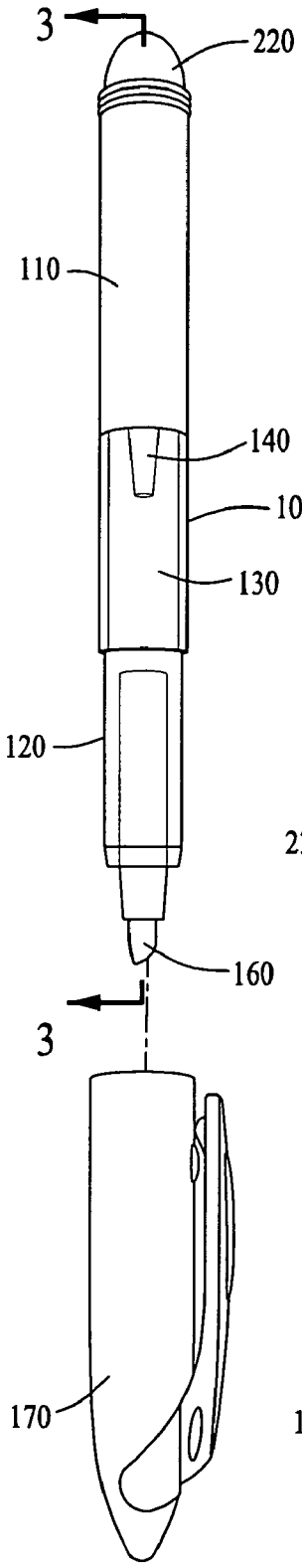
FIG. 1 illustrates a side view of an embodiment of this invention showing the assembled writing instrument of the present invention and a pen cap.

Referring more specifically to the drawings, there is shown in FIG. 1 a preferred embodiment demonstrating the features of the present invention is illustrated. The preferred embodiment is a highlighting marker, although the present invention encompasses other kinds of writing instruments well know in the art. As illustrated, there is a writing instrument body 100 comprised of an upper section 110 capable of connection with a lower section 120. In the preferred embodiment, the walls of the upper section 110 and the lower section 120 are comprised primarily of a clear acrylic plastic. However, other suitable materials may be utilized. A pen cap 170 typically is provided to connect with the lower section 120 and is utilized to cover and protect a pen tip 160, and shirt pockets, when the writing instrument is not in use.

Figure 2:
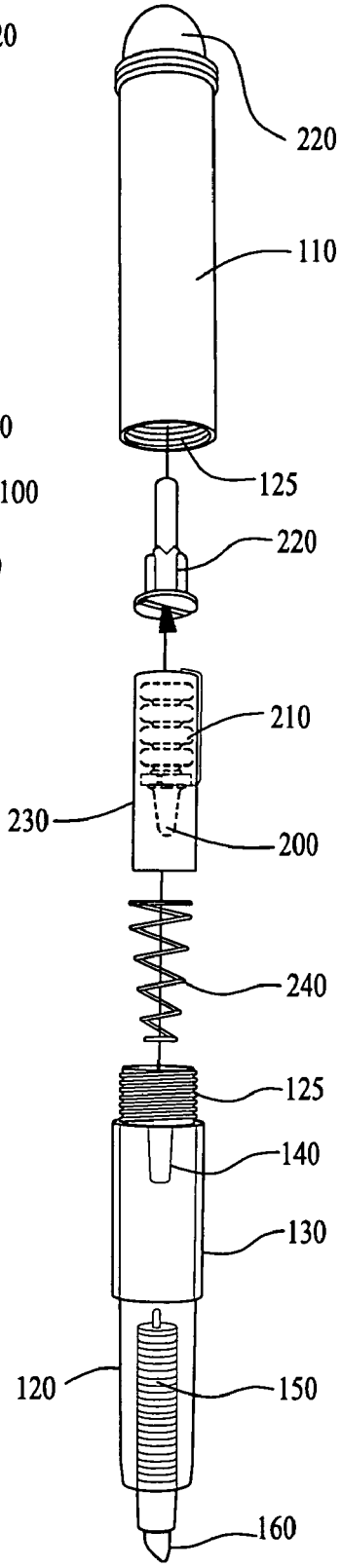
FIG. 2 illustrates a side view of an embodiment of this invention showing the upper section disassembled from the lower section and further showing the electrical components of the writing instrument of the present invention.

Referring also now to FIG. 2, in the preferred embodiment, the upper section 110 and lower section 120 are capable of connecting with each other by threads 125. The lower section 120 is comprised of an ink reservoir 130, and a light conducting member 140. The lower section 120 is further connected with an ink transporting member 150. In the preferred embodiment, the ink reservoir 130 is capable of containing ink 135 and has a wall capable of transmitting light. The bottom end of the ink reservoir 130 is in fluid communication with the ink transporting member 150.

The ink reservoir 130 wall, being preferably transparent or translucent, is capable of transmitting light, thus allowing visibility of the ink 135 to the consumer. The ink reservoir 130 may either be added as a separately constructed chamber that is inserted into the writing instrument body 100 during manufacture of the writing instrument, or the ink reservoir 130 may be integrally formed into the lower section 120 of the writing instrument body 100, for example by molding or injection techniques. In the preferred embodiment, the writing instrument body 100 and ink reservoir 130 are comprised of a clear acrylic plastic. The ink reservoir 130 contains ink 135, for example marking ink. This ink 135 may be of any color, but pastel colored inks will transmit light best. In the preferred embodiment, typical flourescent highlighter ink, for example yellow, pink, and other well known highlighter ink colors, is situated in the ink reservoir 130. Distally, the ink 135 is in fluid communication with the pen tip 160.

Figure 3:
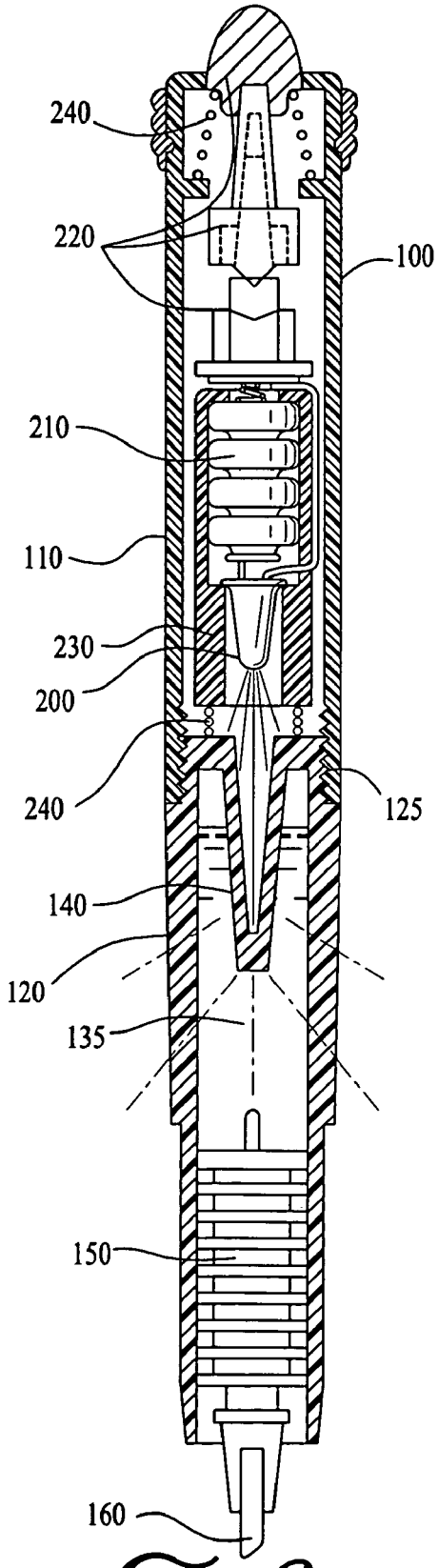
FIG. 3 is a cross sectional view of the assembled writing instrument of the present invention without the pen cap in place.

Referring now also to FIG. 3, the light conducting member 140 is integrated into or connected with the top of the ink reservoir 130, and protrudes downward into the ink reservoir 130. In the preferred embodiment, the light conducting member 140 is comprised of the same material as the ink reservoir 130, and they are both preferably injection molded as an integrated piece during manufacture. The light conducting member 140 in this preferred embodiment is an acrylic shaft, but those in the art will readily recognize other equally suitable materials that conduct light that could be utilized, for example plastics, glass, and fiberoptic materials. Furthermore, in alternative embodiments, the light conducting member 140 could be separately manufactured and then connected with the ink reservoir 130. The light conducting member 140 is preferably slightly conical or rod shaped, but other shapes and configurations could effectively be utilized. The light conducting member 140 is generally aligned with the central axis of the ink reservoir 130. The light conducting member 140 functions to direct the light from a light source 200 into the ink 135. The light is directed generally down the center vertical axis of the ink reservoir 130. This provides the most even and symmetric lighting of the ink 135 and a relatively uniform glowing of the ink 135. The light conducting member 140 may be solid throughout it's length, or as in the preferred embodiment, partially hollow at it's upper aspect. Light from the light source 200 is thereby substantially guided down into the central axis into the ink reservoir 130. The light exits at the bottom tip of the light conducting member 140 and also generally diffuses peripherally from the wall of the light conducting member 140 into the ink 135. In various embodiments, the light conducting member 140 may protrude into the ink reservoir 130 a distance varying from 1 mm up to the full length of the ink reservoir 130. Preferably, the light conducting member 140 protrudes into the ink reservoir 130 approximately one half of the total length of the ink reservoir 130.

The upper section 110 comprises electrical components, that are electrically connected with each other, including the light source 200, a power supply 210, and a switch 220. In the preferred embodiment, the light source 200 and the power supply 210 are contained within an electrical housing 230. The electrical housing 230 makes it more convenient to change the power supply 210, for example batteries, or the light source 200. The electrical housing may also be capable of glowing when electrical current flows through the light source 200. One or more springs 240 may be inserted above or below the electrical housing 230 to help hold the electrical housing 230 in place when the upper section 110 is connected with the lower section 120 of the writing instrument. At the top of the upper section 110 is the switch 220.

The light source 200 is preferably located in proximity to the bottom of the upper section 110, so that the light source 200 is adjacent to the ink reservoir 130 when the upper section 110 is connected with the lower section 120. The light source 200 is oriented so as to guide light from the light source 200 down the light conducting member 140 and into the ink reservoir 130. The light source 200 in the preferred embodiment is an LED. Other light sources, for example light bulbs, may be substituted, as will be recognized by those skilled in the art. The light source 200 is electrically connected with the power supply 210 and the switch 220. The light source 200 in at least one embodiment emits light of UV wavelength, i.e. "black light". This wavelength of light will result in a flourescent ink glowing brightly when illuminated by the UV light. In alternative embodiments, multiple or variously colored light sources may also be utilized.

When the switch 220 is turned on, current will flow through the light source 200 from the power supply 210. The light will then be transmitted by the light conducting member 140 into the ink reservoir 130, and, in the preferred embodiment, down the generally central axis of the ink reservoir 130. This will cause the ink 135 within the ink reservoir 130 to illuminate and glow. When the switch 220 is turned off, no current flows through the light source 200 and power is conserved until the illumination of the ink 135 is again desired.

Although in this embodiment, the majority of the writing instrument body 100 is transparent, any portion of the writing instrument body 100 could be translucent or opaque. For example, there may be opaque metal or opaque plastic segments, translucent etchings, advertising, or labels on a portion of the writing instrument body 100. The ink reservoir 130 may be covered with a partially translucent surface feature, such as advertising or indicia, that will cause the advertising to glow when the switch 220 is turned on. The ink reservoir 130 could also have opaque indicia that will then be outlined by the illuminated ink 135. In other embodiments of this invention, advertising or other indicia are applied to the surface of the writing instrument. This may either be in the form of a label applied to the outside or inside of the writing instrument body 100, or indicia etched directly onto the writing instrument body 100.

Figure 4:
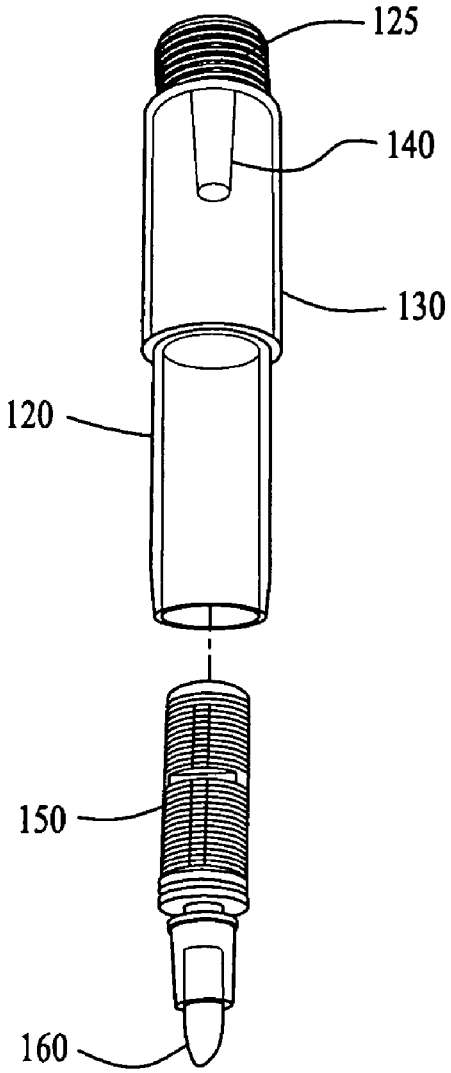
FIG. 4 illustrates the lower section with the ink transporting member disconnected from the ink reservoir.

Referring now also to FIG. 4, the ink transporting member 150 is of a type well known in the art and commonly used in highlighter markers. The ink transporting member 150 connects to the bottom of the ink reservoir 130. The ink transporting member 150 may be selected from any of those well known in the art and will not be described in further detail herein. The pen tip 160 is in fluid communication with the ink 135 within the ink reservoir 130 via the ink transporting member 150. The particular type of pen tip is not essential to the present invention. Although in the preferred embodiment, the invention is a highlighter marker with a highlighter type of pen tip 160, the present invention is not limited only to highlighter types of marking pens and is intended to include various other types of writing instruments.

Figure 5:
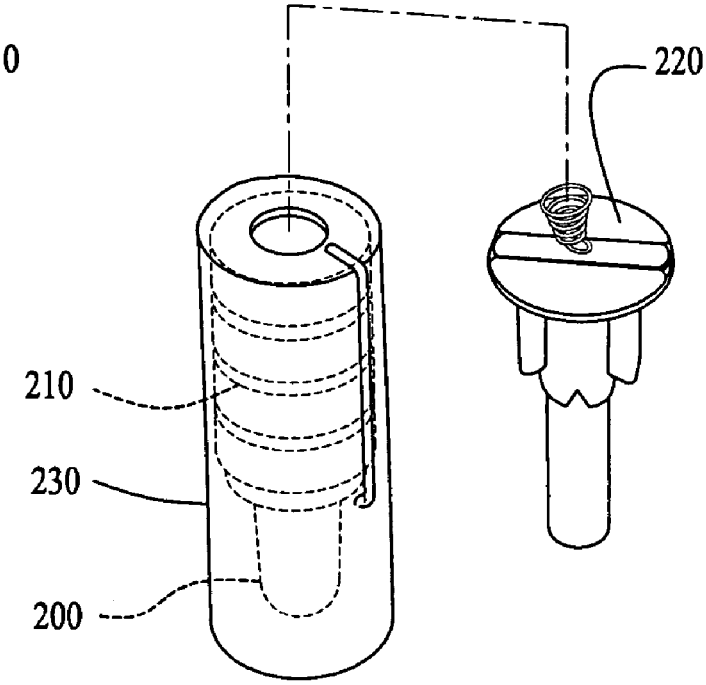
FIG. 5 shows the electrical components, including the electrical housing, in more detail and also shows a part of the electrical switch.

The electrical housing 230 and part of the switch 220, are shown in greater detail in FIG. 5. In the preferred embodiment, the power supply 210 comprises stacked batteries, for example watch batteries, although it is obvious to one skilled in the art that fewer or greater numbers of batteries will be equivalently effective as a power supply 210. In the preferred embodiment the switch 220 is a plunger type electrical switch well known in the art. As the top of the pen is pressed down and released, the plunger rotates in an alternating sequence between on and off positions. However, various switches, power supplies, and light sources may be utilized. These electrical components are all well known to those in the art, for example in penlights, and their assembly and equivalents need not be discussed in more detail herein.

The present invention further includes a method of advertising. The advertising method includes constructing a writing instrument capable of illumination of ink 135 in an ink reservoir 130 as described supra. Advertising is placed upon the writing instrument body 100. The writing instrument is then provided to a consumer or business. The glowing ink will attract the attention of a consumer or a business to the advertising.

The present invention may be embodied in other specific forms without departing from the essential spirit or attributes thereof. It is desired that the embodiments described herein be considered in all respects as illustrative, not restrictive, and that reference be made to the appended claims for determining the scope of the invention.

What is claimed is:

1. A writing instrument comprising:

a. an elongated instrument body;

b. a light source;

c. an ink reservoir containing ink in proximity to said light source, said ink reservoir being defined by said instrument body; and d. a pen tip attached to an end of said instrument body and in fluid communication with said ink reservoir wherein a majority of light emitted from said light source is directed into said ink reservoir so as to illuminate the ink within said ink reservoir when current flows through said light source, and said ink reservoir is fabricated of light transmitting material so as to make said illuminated ink visible when light is directed thereupon.

2. A writing instrument as in claim 1 wherein said ink reservoir is at least partially transparent.

3. A writing instrument as in claim 1 wherein said ink reservoir is at least partially translucent.

4. A writing instrument as in claim 1 wherein the pen tip is a highlighter marker type of pen tip.

5. A writing instrument as in claim 1 wherein the light source is an LED.

6. A writing instrument as in claim 1 wherein the light source is a light bulb.

7. A writing instrument as in claim 1 further comprising advertising upon the writing instrument body.

8. The writing instrument as in claim 1, wherein said pen tip is non-retractable.

9. The writing instrument as in claim 1, wherein said light source emits ultraviolet light and said ink has fluorescent properties.

10. A writing instrument comprising:

a. an elongated instrument body;

b. a light source;

c. an ink reservoir containing ink, said ink reservoir being defined by said instrument body; and d. a pen tip attached to an end of said instrument body and in fluid communication with said ink reservoir; and e. a light conducting member in luminescent communication with said light source, said light conducting member extending into and in fluid communication with said ink reservoir, said light conducting member being configured to direct a majority of light emitted from said light source into said ink reservoir so as to illuminate the ink in said ink reservoir, wherein said ink reservoir is fabricated of light transmitting material so as to make said illuminated ink visible when light is directed thereupon.

11. A writing instrument as in claim 10 wherein said instrument body comprises detachably connected upper and lower sections and:

a. said light source is housed in said upper section; and b. said ink reservoir and light conducting member are housed in said lower section.

12. The writing instrument as in claim 11, wherein said upper section further comprises a power supply for supplying power to said light source and a switch for powering on and off said light source.

13. The writing instrument as in claim 12, wherein said upper and lower sections are threadably connected to each other.

14. A writing instrument as in claim 10 wherein said ink reservoir is at least partially transparent.

15. A writing instrument as in claim 10 wherein said ink reservoir is at least partially translucent.

16. A writing instrument as in claim 10 wherein said light conducting member is configured and oriented such that a majority of light from said light source entering said ink reservoir is directed generally into the central vertical axis thereof.

17. A writing instrument as in claim 10 wherein said ink has fluorescent properties.

18. A writing instrument as in claim 10 wherein said light source emits ultraviolet "black" light when switched on.

19. A writing instrument as in claim 10 wherein the pen tip is a highlighter marker type tip.

20. A writing instrument as in claim 10 wherein the light source is an LED.

21. A writing instrument as in claim 10 further including advertising indicia on the body of said writing instrument.

22. The writing instrument as in claim 1, further comprising a power supply for supplying power to said light source and a switch for powering on and off said light source.

23. The writing instrument as in claim 22, wherein said body comprises detachably connected upper and lower sections.

24. The writing instrument as in claim 23, wherein said light source, power supply, and switch are disposed in said upper section, and said ink reservoir and pen tip are disposed in said lower section.

25. The writing instrument as in claim 24, wherein said upper and lower sections are threadably connected to each other.

26. The writing instrument as in claim 10, wherein said light conducting member is generally conical in shape.

27. The writing instrument as in claim 10, wherein said light conducting member extends into said ink reservoir at least one half of the total length of said ink reservoir.

28. The writing instrument as in claim 10, wherein said pen tip is non-retractable.

29. The writing instrument as in claim 10, wherein said light source is a light bulb.

* * * * *